US006336460B2

(12) United States Patent
Yuhara

(10) Patent No.: US 6,336,460 B2
(45) Date of Patent: Jan. 8, 2002

(54) SEALABLE CASE

(75) Inventor: Yukitomo Yuhara, Abiko (JP)

(73) Assignee: Yoshida Industry Co., Ltd., Tokyo (JP)

( * ) Notice: Subject to any disclaimer, the term of this patent is extended or adjusted under 35 U.S.C. 154(b) by 0 days.

(21) Appl. No.: 09/798,893

(22) Filed: Mar. 6, 2001

(30) Foreign Application Priority Data

Mar. 15, 2000 (JP) ..... 12-072124

(51) Int. Cl.[7] ..... A45D 33/24
(52) U.S. Cl. ..... 132/295; 132/300
(58) Field of Search ..... 132/296, 300, 132/305, 295; 220/526, 531, 554, 256, 258

(56) References Cited

U.S. PATENT DOCUMENTS

| | | | | |
|---|---|---|---|---|
| 5,638,838 A | | 6/1997 | Lombardi | |
| 5,884,636 A | * | 3/1999 | Sheffler et al. | 132/295 |
| 6,009,885 A | * | 1/2000 | Nam | 132/305 |

FOREIGN PATENT DOCUMENTS

| | | |
|---|---|---|
| JP | 59-67104 | 5/1984 |
| JP | 59-67105 | 5/1984 |
| JP | 62-13541 | 4/1987 |
| JP | 62-13542 | 4/1987 |
| JP | 2523785 | 10/1996 |
| JP | 10-192044 | 7/1998 |
| JP | 11-56455 | 3/1999 |

* cited by examiner

*Primary Examiner*—Todd E. Manahan
(74) *Attorney, Agent, or Firm*—Morrison & Foerster LLP

(57) ABSTRACT

A sealable container comprised of a container body to which an internal hinged lid is installed as means of sealing or exposing an internally located substance-containing space, and a separate external cover that screws onto the container body. When attached, the external cover presses downward onto the internal lid to seal the lid against the substance-containing space. A hinge mechanism, consisting of a hinge pin and specific hinge boss design, is located between the container body and internal lid. The hinge boss incorporates a yoke with an elongated channel able to grip the hinge pin while also sliding along the hinge pin in a linear direction as the internal lid moves downward against the substance-containing space.

19 Claims, 6 Drawing Sheets

(a)

(b)

SEALABLE CASE

BACKGROUND OF THE INVENTION

1. Field of the Invention

The invention relates to a sealable case that incorporates a hinged inner cover mounted so as to pivot over an inner space, said inner cover being thus able to expose or seal the inner space, and a separate outer cover that attaches to the case body by means of an interlocking thread structure located there between.

2. Description of the Related Art

Japanese Utility Model Registration No. 2523785 teaches a structure for a sealable container, commonly utilized as a cosmetic compact, that incorporates an internal lid. This cosmetic compact is comprised of a main body part that defines an internal space, an internal lid capable of covering the aforesaid space, and an external cover capable of covering the aforesaid internal lid. The internal lid is hinge mounted so as to rotatably expose or close against the aforesaid internal space. The external cover removably installs to the main body part by means of interlocking screw threads, and when in an installed position, forcibly presses against the internal lid, thus sealing the internal space from the external environment.

The internal lid hinge structure utilized in this type of cosmetic compact is comprised of a hinge pin installed within a cutout section formed in the upper periphery of the main body part, and a hinge boss protruding from the periphery of the inner cover, said hinge boss receiving the aforesaid hinge pin so as to form a pivoting connection between the aforesaid main body part and hinge boss.

Because the hinge boss is installed to the hinge pin at a fixed position, the inner lid is capable of moving only on the rotational axis defined by the fixed hinge pin. As movement of the hinge boss is restricted to this single rotational axis, when the external cover is closed against the internal lid, the internal lid is strongly pressed against the periphery of the internal space only at the region opposite the hinge. In spite of the skirt shaped sealing material installed at the periphery of the internal space, the internal lid is not capable of applying uniform pressure around the entire circumference of the internal space, thus resulting in a relatively weak seal between the internal space and external environment.

Moreover, the structure taught by the aforesaid Japanese Utility Model Patent does not provide means to eliminate the open space required to house the hinge structure between the external cover and main body part, thus necessitating that the hinge structure be installed directly between the external cover and main body part. Furthermore, the screw threads used to secure the external cover to the main body part must be structured in a way that avoids the hinge structure, thus necessitating that the external cover be made larger when it is often desired to make the main body part small and compact.

SUMMARY OF THE INVENTION

The invention provides a structure for a sealable case whereby an internal lid is strongly and uniformly pressed against the periphery of an internal space when the external cover is secured to the main body part, thus providing for an improved internal space sealing function.

The invention is comprised of a main body part, an external wall peripherally formed on the main body part that defines an internal space within the main body part, fastening threads formed on the periphery of the external wall, a hinge installed within a space on the outwardly facing perimeter of the main body part, an internal lid rotatably installed to the main body part through the hinge so as to movably cover or expose the internal space, a separate external cover, screw threads 23 formed on the inwardly facing perimeter of a cover wall of the external cover, screw threads provided as means of removably connecting the external cover to the main body part by interlocking with the aforesaid fastening threads, whereby the internal lid is forcibly pressed against the upwardly facing perimeter of the internal space, by the external cover, so as to form an air-tight seal therebetween, and a sliding yoke that allows a linear movement of the internal lid when the internal lid is pressed against the perimeter of the internal space.

The hinge structure is comprised of a hinge pin and a hinge boss which are provided with the main body part and internal lid, respectively. A hinge tongue extends downward from the perimeter of the internal lid and incorporates either the hinge boss or hinge pin at its extremity. The sliding yoke, formed as a relatively long channel within the hinge boss, provides means of rotatably connecting the hinge boss to the hinge pin so as to form a sliding hinge mechanism that allows the linear movement of the internal lid in relation to the main body part.

The main body part 11 incorporates an expanded portion that radially extends from the lower region of the external wall, the expanded portion being located below the lower edge of the cover wall of the external cover. The hinge tongue, formed as an integral extension of the perimeter of the internal lid, resides in a cutout space and extends to the expanded portion. The expanded portion may be formed as a circular flange, the outer perimeter of the circular flange is formed to the approximate same diameter as that of the cover wall of the external cover as means of aligning the perimeter of the circular flange with the cover wall of the external cover when the external cover is attached to the main body part.

The external cover incorporates a pressure lip that is located so as to come into contact with the internal lid when the external cover is installed to the main body part. A contact seat may be formed on the perimeter of the internal lid as means of creating a specific area of contact against the external cover. The internal lid may also be structured so as to be pressed down by the external cover without the use of the aforesaid pressure lip.

In cases where a substance is contained within the internal space, a packing piece may be provided as means of forming a more effective seal between the internal lid and the main body part when the internal lid is brought into contact with the external wall of the main body part.

The invention also allows for the utilization of a separate substance container that can be removably installed within the internal space as means of conveniently filling or removing a substance from the internal space. A container wall can be formed to a height slightly lower than that of the external wall of the main body part as means of allowing the internal lid to form a seal against the main body part. As needs dictate, a packing piece may also be utilized with this structure as means of forming a more efficient seal between the internal lid and the main body part.

Conversely, in regard to the aforesaid structure in which the removable container is utilized, the container wall may be formed to a height slightly higher than that of the external wall as means of allowing the internal lid to form a seal directly against the upper edge of the container wall. In this case, a packing piece may also be utilized as means of forming a more efficient seal between the internal lid and the container.

The invention puts forth a structure for a sealable case comprised of a main body part incorporating an external wall that defines an internal space and has fastening threads provided on an outwardly facing perimeter surface thereof, an internal lid capable of rotatably sealing or exposing the internal space, a hinge installed between the internal lid and the external wall of the main body part, and an external cover incorporating screw threads formed on the inwardly facing surface of a circumferential wall. When the external cover is screwed onto the main body part, the external cover simultaneously presses the internal lid against the internal space so as to form an atmospheric seal between the internal lid and internal space. The hinge incorporates a hinge pin and a hinge boss provided with the external wall of the main body part and the internal lid, respectively, the hinge boss rotates freely on the hinge pin. A sliding yoke connects the hinge pin and hinge boss in a manner so as to allow a linear movement of the internal lid in relation to the hinge pin when the internal lid is pressed down by the external cover.

The invention further puts forth a structure for a sealable case comprised of a main body part incorporating an external wall defining an internal space and having fastening threads provided on a perimeter surface thereof, a hinge installed within the external wall, a rotatably installed internal lid capable of sealing or exposing the internal space, and an external cover incorporating screw threads formed on the inwardly facing surface of a circumferential wall, the screw threads being capable of removably connecting with the fastening threads on the main body part. This external cover fastening operation also presses the internal lid against the internal space so as to form an atmospheric seal between the internal lid and the internal space. Moreover, a radially extending expanded portion is provided at the lower region of the external wall of the main body part, the upwardly facing surface of the expanded portion being located opposite to the perimeter wall of the external cover when the external cover is attached to the main body part. The internal lid incorporates a tongue part that extends to the expanded portion through a cutout space provided in the perimeter of the external wall. The aforesaid hinge utilizes a hinge pin and a hinge boss provided with the tongue part of the internal lid and the expanded portion of the main body part, respectively. The hinge provides a structure through which the hinge boss is able to rotate on the hinge pin, as well as move in a linear direction, when the internal lid is pressed downward by the closing external cover, by means of a sliding yoke formed within the hinge boss as an elongated channel able to grip the hinge pin securely while simultaneously moving in a linear direction in relation to the hinge pin.

In order to seal the internal space in the main body part, the internal lid is pressed down onto the internal space by the external cover as the external cover is screwed onto the main body part. During this operation the internal lid is forcibly pressed down against the periphery of the internal space while moving in rotational and linear directions made possible by the yoke sliding over the hinge pin, thus allowing the internal lid to apply uniform pressure against the entire periphery of the internal space as means of forming a more effective atmospheric seal.

As stated previously, the invention provides for the structure in which the hinge boss is able to rotate so as to allow the internal lid to seal or expose the internal space. Furthermore, when the external cover is attached to the main body part, the yoke part of the hinge boss is able to move in the linear direction while the external cover is secured to the main body part, thus allowing the internal lid to move on the linear axis in response to the downward pressure applied by the closing external cover. This linear movement is made possible by the simple structure of the elongated channel that comprises the yoke in the hinge boss.

As mentioned previously, the invention specifies the tongue and the cutout space that extend downward to the expanded portion at the lower external region of the main body part. Locating the expanded portion directly beneath the lower edge of the external cover (when the external cover is attached to the main body part) allows the hinge to be positioned outside of the external cover. Moreover, this structure assures that the fastening threads do not interfere with the operation of the hinge, thus eliminating the need to provide a space for the hinge directly between the external cover and main body part, and thus making it possible for a small sealed case to hold a relatively large volume of substance.

Furthermore, an external appearance of the sealable case is improved as a result of the circular flange as the expanded portion at the base of the main body part aligning with the edge of the external cover. Appropriate uniform sealing pressure can be applied as a result of the pressure lip on the external cover pressing against the contact seat on the internal lid. Moreover, by specifying the contact region of the internal lid in accordance with sealing needs of a specific substance, a high degree of sealing efficiency can be maintained and further augmented by the use of the packing piece.

DESCRIPTION OF THE PREFERRED EMBODIMENT

Figure 1:
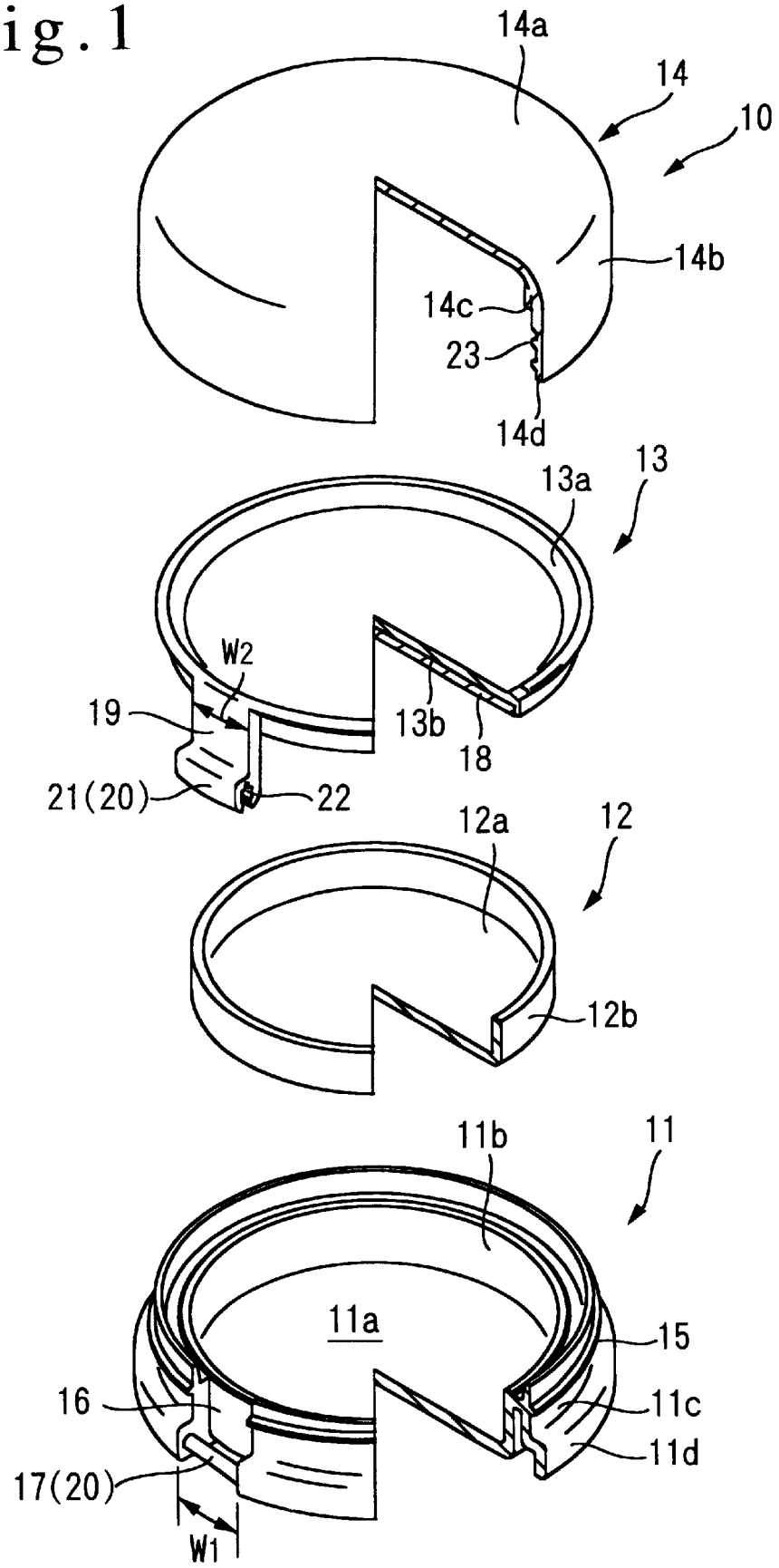
FIG. 1 is an oblique exploded partial cross sectional view of the first embodiment of the invention.
Figure 2:
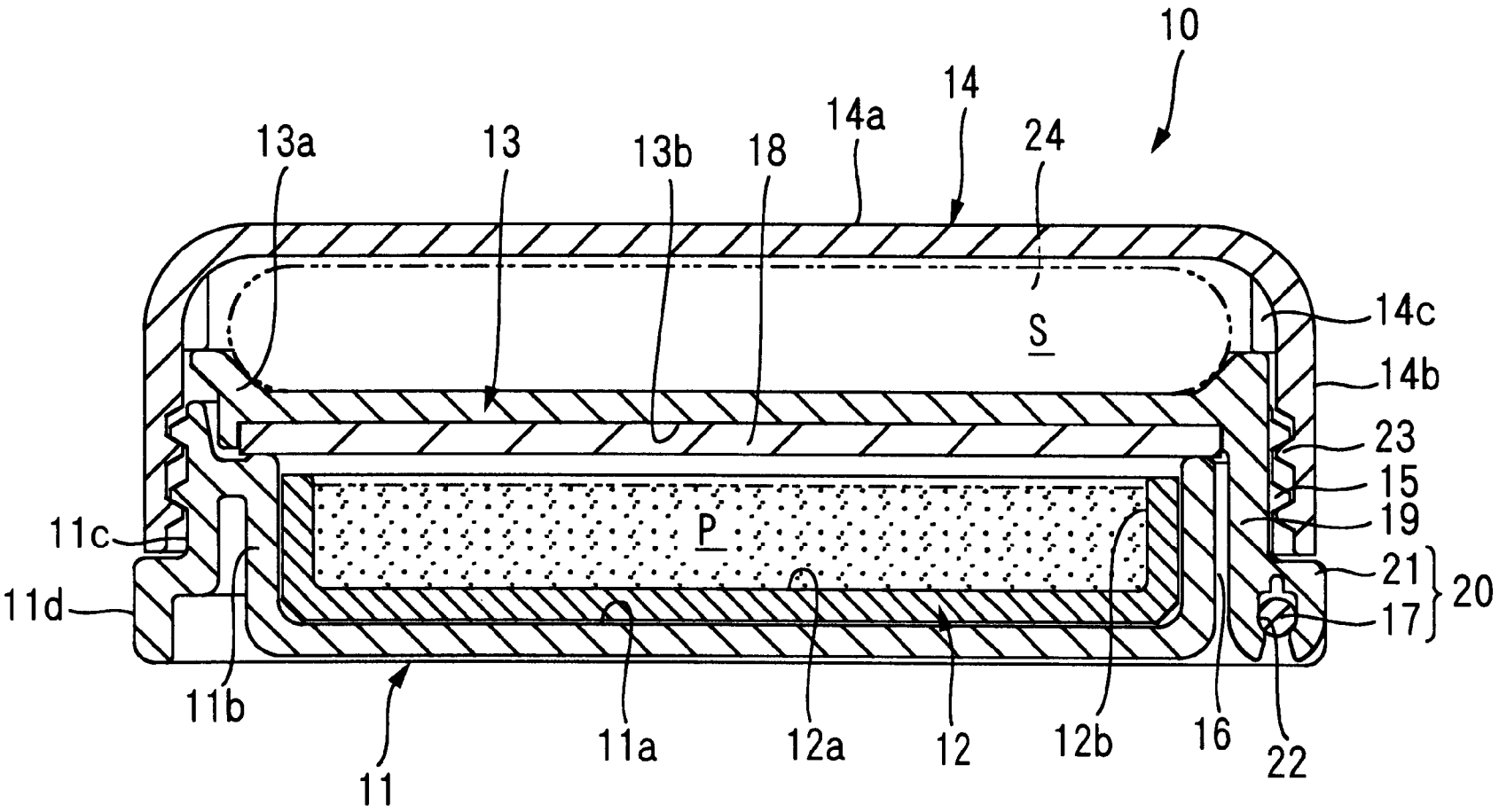
FIG. 2 is a side view cross section of the first embodiment showing the sealable case with the external cover attached.

The invention is shown, in both FIGS. 1 and 2, as portable jar-type cosmetic case 10.

In the first embodiment, cosmetic case 10 as a sealable case provides a structure whereby internal space 11*a* is effectively sealed from the external environment as a result of downward pressure applied to internal lid 13 against space 11*a*when external cover is 14 is securely attached to main body part 11. Cosmetic case 10 is comprised of main body part 11 that defines centrally located internal space 11*a,* cosmetic container 12 that is removably installable to space 11*a,* hinge 20 that is installed within main body part 11, internal lid 13 that is capable of sealing or exposing space 11*a,* and external cover 14 that is installable to main body part 11 by means of screw threads, and in doing so completely covers internal lid 13. The operation whereby external cover 14 is screwed onto main body part 11 results in the external cover also pressing internal lid 13 downward over and sealing internal space 11*a.* The salient point of this structure is the design and location of hinge 20 that makes use of sliding yoke 22 as means of allowing internal lid 13 to slide linearly as it is rotatably pushed downward by external cover 14.

Main body part 11 is circular in shape as resulting from the shape of circular internal wall 11*b* that defines internal space 11*a*. External wall 11*c* is an extension of the part of wall 11*b* that is bent radially outward and downward, thus forming a double wall structure consisting of walls 11*c* and 11*b*. The upper edge of external wall 11*c* extends to a higher point than that of the upper edge of internal wall 11*b*. Screw threads 15 are formed at the upper region of the external surface of external wall 11*c* as means of connecting to fastening threads on external cover 14. Circular base flange 11*d* as an expanded portion is formed as a flange that extends radially outward from external wall 11*c* below screw threads 15. Cutout space 16, formed to width dimension W1, is a vertically oriented channel formed at one location within external wall 11*c*, and extends downward from the top of external wall 11*c* to base flange lid. Hinge pin 17 is horizontally installed within cutout space 16 at the level of base flange 11*d*.

Cosmetic container 12 is formed as a circular tray-type structure defined by floor 12*a* and container wall 12*b*, and is of the approximate same diameter as internal space 11*a*. As shown in FIG. 2, container 12 may be filled with cosmetic substance P, and may be installed or removed from internal space 11*a*. The height of container wall 12*b* is lower than that of internal wall 11*b*, thus allowing the upper edge of internal wall 11*b* to extend to a point above that of container wall 12*b*.

Internal lid 13 is a round plate-like structure that fits within external wall 11*c* of main body part 11. Contact seat 13*a* is formed on internal lid 13 as a round flange extending upward from the perimeter of internal lid 13. Surface 13*b*, an inverted dish-type structure on the lower surface of internal lid 13, is formed to a diameter larger than that of internal wall 11*b*, and has packing piece 18 installed thereon. Tongue 19, a downwardly extending flange formed at one point on the perimeter of internal lid 13, resides within cutout space 16, extends to the upper surface of base flange lid, and is specified as width W2 as shown in FIG. 1. When external cover 14 is secured to main body part 11, the lower part of tongue 19 is exposed beneath lower edge 14d of external cover 14. Hinge 20 is installed between the lower end of tongue 19 and base flange 11*d*.

Hinge 20 is comprised of hinge pin 17 horizontally installed within the walls that define cutout space 16, and hinge boss 21 that rotatably attaches to hinge pin 17. Hinge boss 12 incorporates two downwardly extending flanges that comprise sliding yoke 22. These flanges are structured so as to allow yoke 22 to simultaneously slide and rotate on hinge pin 17, and thus allow internal lid 13 to slide linearly while rotating downward as a result of pressure applied by external cover 14. To be specific sliding yoke 22 is an elongated channel oriented in the same direction as that of the moving direction of internal lid 13 when closing against internal space 11*a*.

External cover 14 is comprised of top plate 14*a*, and perimeter wall 14*b* which is formed as a downwardly extending cylindrical extension of the perimeter of top plate 14*a*. Female screw thread 23 is formed on the inner surface of wall 14*b* as means of removably connecting to male fastening thread 15 located on external wall 11*c* of main body part 11. Pressure lip 14*c* is formed at the upper region of the internal surface of perimeter wall 14*b*, the purpose of pressure lip 14*c* being to press against seat 13*a* of internal lid 13 when external cover 14 is secured to main body part 11. In a condition where external cover 14 is completely attached to main body part 11, lower edge 14*d* of perimeter wall 14*b* is located directly above base flange 11*d* of main body part 11. A pleasing appearance of the cosmetic container is realized as a result of external cover 14 and base flange 11*d* having the approximate same diameter. Pressure lip 14*c* may be formed either as a continuous round ring structure, or as intermittently spaced lip parts.

As shown in FIG. 2, cosmetic container 12 is removably installed within internal space 11*a*of main body part 11, internal lid 13 is rotatably attached to main body part 11 through hinge 20, and external cover 14 is secured to and covers main body part 11 by means of fastening threads provided there between. Hinge 20 is a structure in which internal lid tongue 19 is inserted into cutout space 16 of main body part 11, and in which hinge boss 21, located at the lower region of tongue 19, is rotatably connected to hinge pin 17. Cosmetic powder puff 24 or other like implement resides in the space between internal lid 13 and external cover 14.

Figure 3:
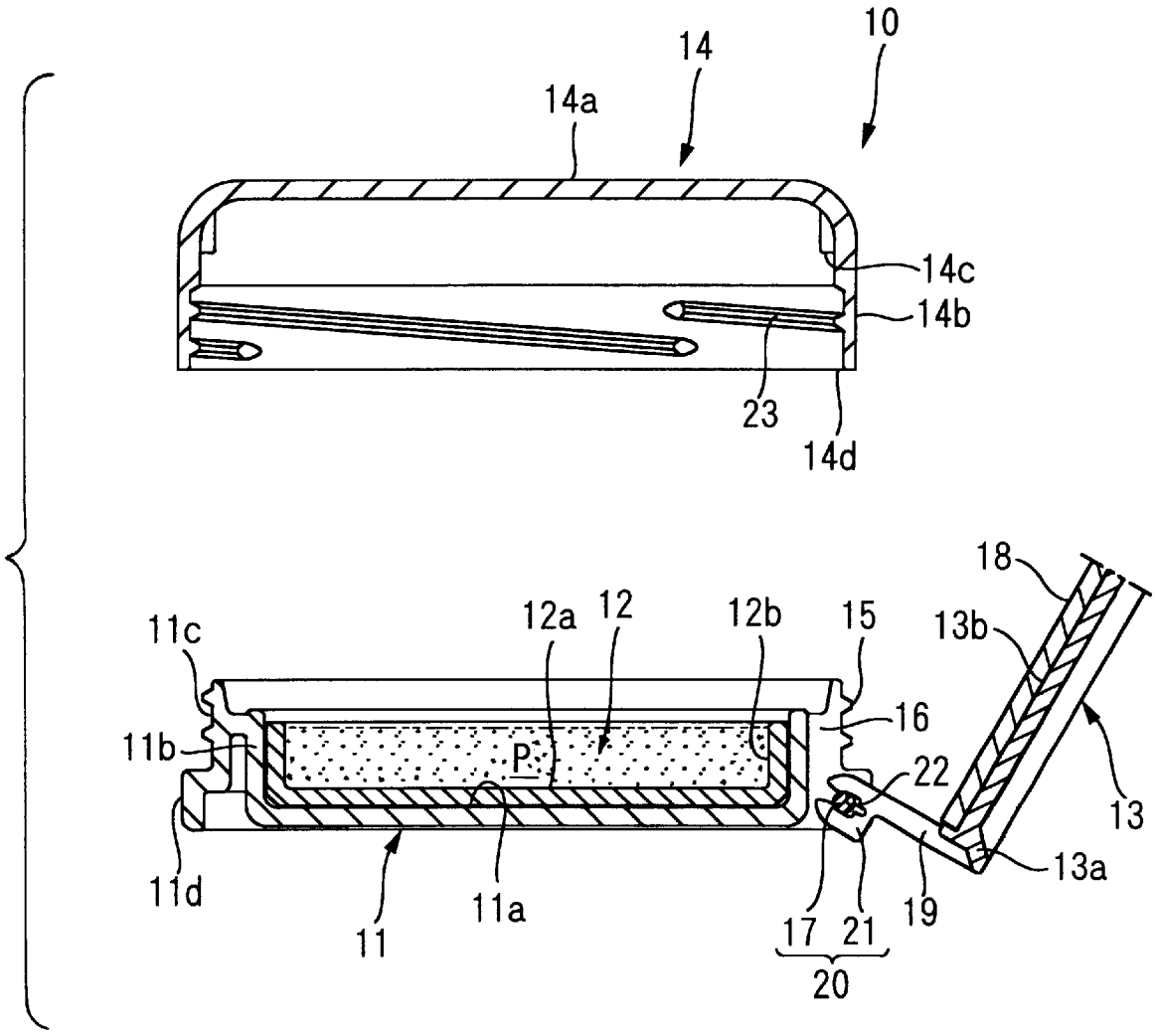
FIG. 3 is a side view cross section of the first embodiment showing the sealable case with the external cover removed and the internal lid open.

FIG. 3 shows a cross sectional view of the first embodiment in which external cover 14 is removed and internal lid 13 is opened to expose cosmetic container 12. Internal space 11*a*is exposed, thereby allowing cosmetic substance P to be picked up by powder puff 24 and utilized as needed. When the cosmetic substance need no longer be accessed, internal lid 13 is closed over space 11*a*,and external cover 14 is screwed down over main body part 11, thus forming a double sealing mechanism around space 11*a*.

When external cover 14 is securely attached to main body part 11, a highly efficient seal is maintained around internal space 11*a*by means of packing piece 18 installed to internal cover 13. This seal, formed when external cover 14 is securely screwed down onto main body part 11, is established by the mechanism in which contact seat 13*a* of internal lid 13 is forcibly pressed down over space 11*a*by pressure lip 14*c* of external cover 14. The force applied by external cover 14 is thus transferred from pressure lip 14*c* to the perimeter region of internal lid 13, and thus against the upper edge of internal wall 11*b* of main body part 11 through packing piece 18.

Figure 4:
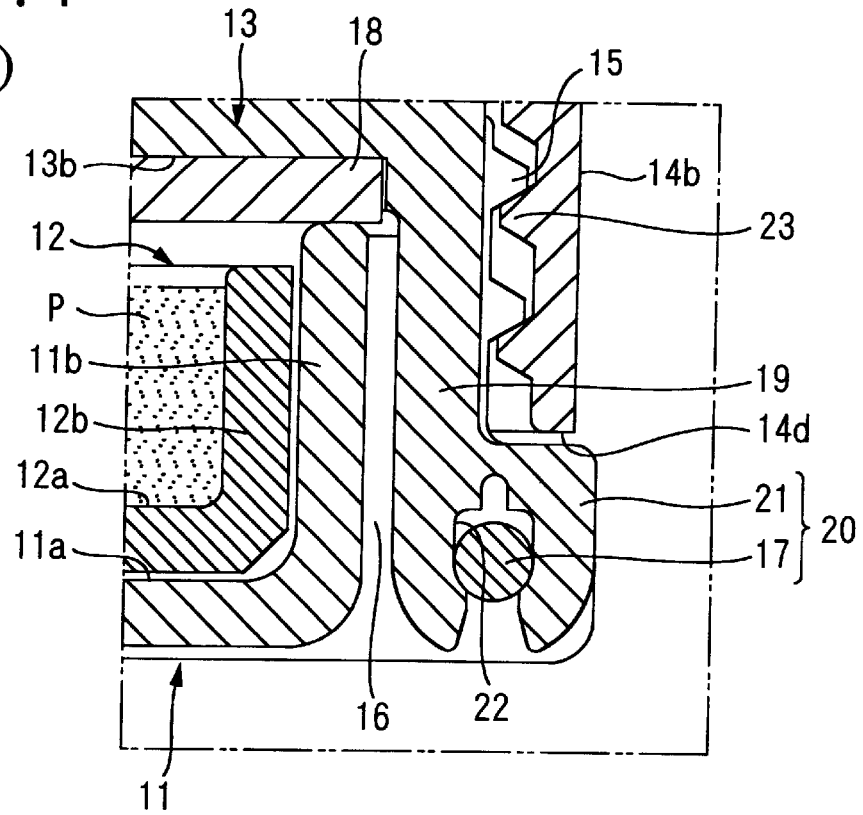
FIG. 4 is a partial enlarged cross section of the first embodiment showing the operation of the hinge structure.
Figure 4:
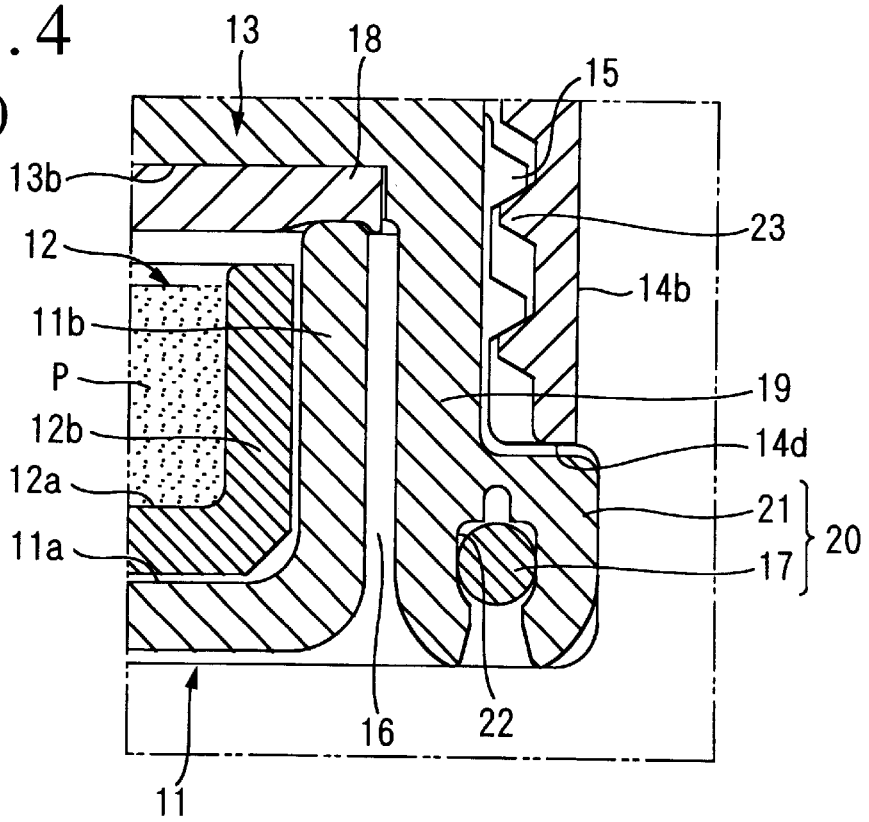

As result of sliding yoke 22 being structured so as to maintain a secure grip on hinge pin 17 while also sliding over it, internal lid 13 and tongue 19 are able to move downward in a compound linear and rotating motion when external cover 14 is secured to main body part 11. As shown in the detailed cross section of FIG. 4*a*, hinge boss 21 grips hinge pin 17 at the lower end of sliding yoke 22 when packing piece 18 comes into contact with the upper edge of internal wall 11*b* as a result of internal lid 13 being initially closed over internal space 11*a*. As shown in the detail cross section of FIG. 4*b*, when external cover 14 is screwed down onto main body part 11, hinge boss 20 is able to rotate while also sliding downward along hinge pin 17 as a result of the elongated channel in sliding yoke 22, thus allowing internal lid 13 to move with a compound rotating and linear motion as it closes against internal space 11*a*. As a result, packing piece 18 is compressed against the upper edge of internal wall 11 with uniform pressure along the entire perimeter, thus providing for a more secure and efficient sealing function between both components, and an improved sealing function for internal space 11*a*.

As a result of the aforesaid improved sealing function, the cosmetic substance P is prevented from leaking out of the cosmetic case, and cosmetic substances that tend to evaporate quickly can be preserved longer. Furthermore, because packing piece 18 is compressed against inner wall 11*b* with uniform pressure, the packing piece deteriorates less over time and lasts longer.

The use of tongue 19 allows hinge 20 to be installed within base flange lid of main body part 11, thus also allowing base flange lid to be located directly beneath external cover 14. Hinge 20 is thus able to be located at a position external to the external cover 14, and screw threads 15 and 23 can be formed without consideration of the location of hinge 20. In other words, it is not necessary to provide for a hinge housing space directly between external cover 14 and main body part 11. This means that internal space 11*a* can be structured to hold a relatively large amount of cosmetic material, without the need for a large external cover, in a cosmetic case having compact external dimensions. Obviously, as tongue 19 is located within cutout space 16, it offers no interference with the joint formed between fastening threads 15 and 23.

Figure 5:
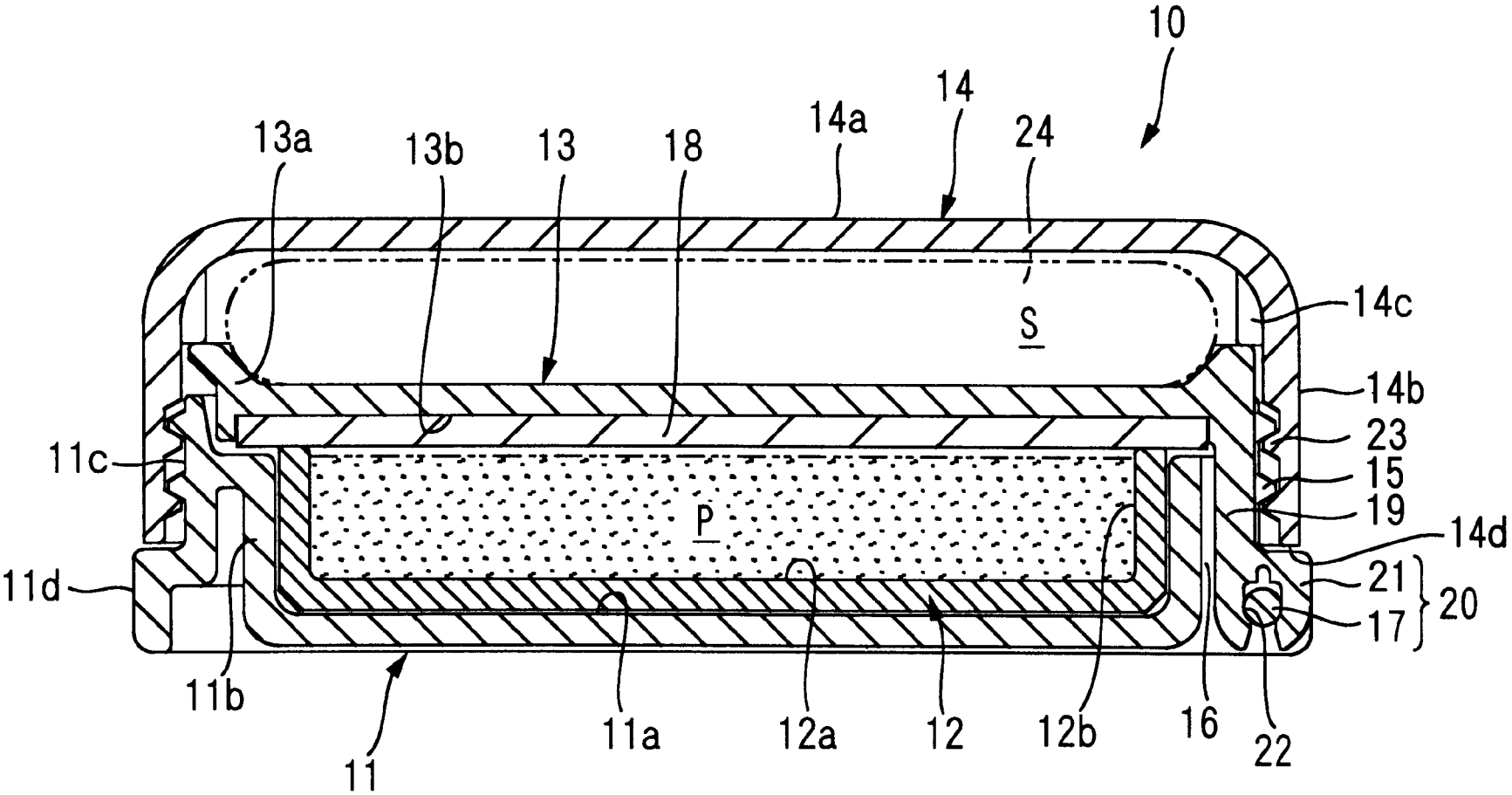
FIG. 5 is a side view cross section of the second embodiment of the invention with the external cover attached.

FIG. 5 presents a second embodiment of the invention wherein container wall 12*b* of container 12 is formed to a height greater than that of internal wall 11*b* of main body part 11. Packing piece 18 thus seals internal space 11*a*by compressing against the upper edge of container wall 12*b* instead of internal wall 11*b* as taught by the first embodiment. In this second embodiment, packing piece 18 is compressed uniformly over the upper edge of container wall 12*b* as a result of external cover 14 pressing internal lid 13 downward in a compound linear and rotating action made possible by the compound movement of sliding yoke 22 around hinge pin 17.

Figure 6:
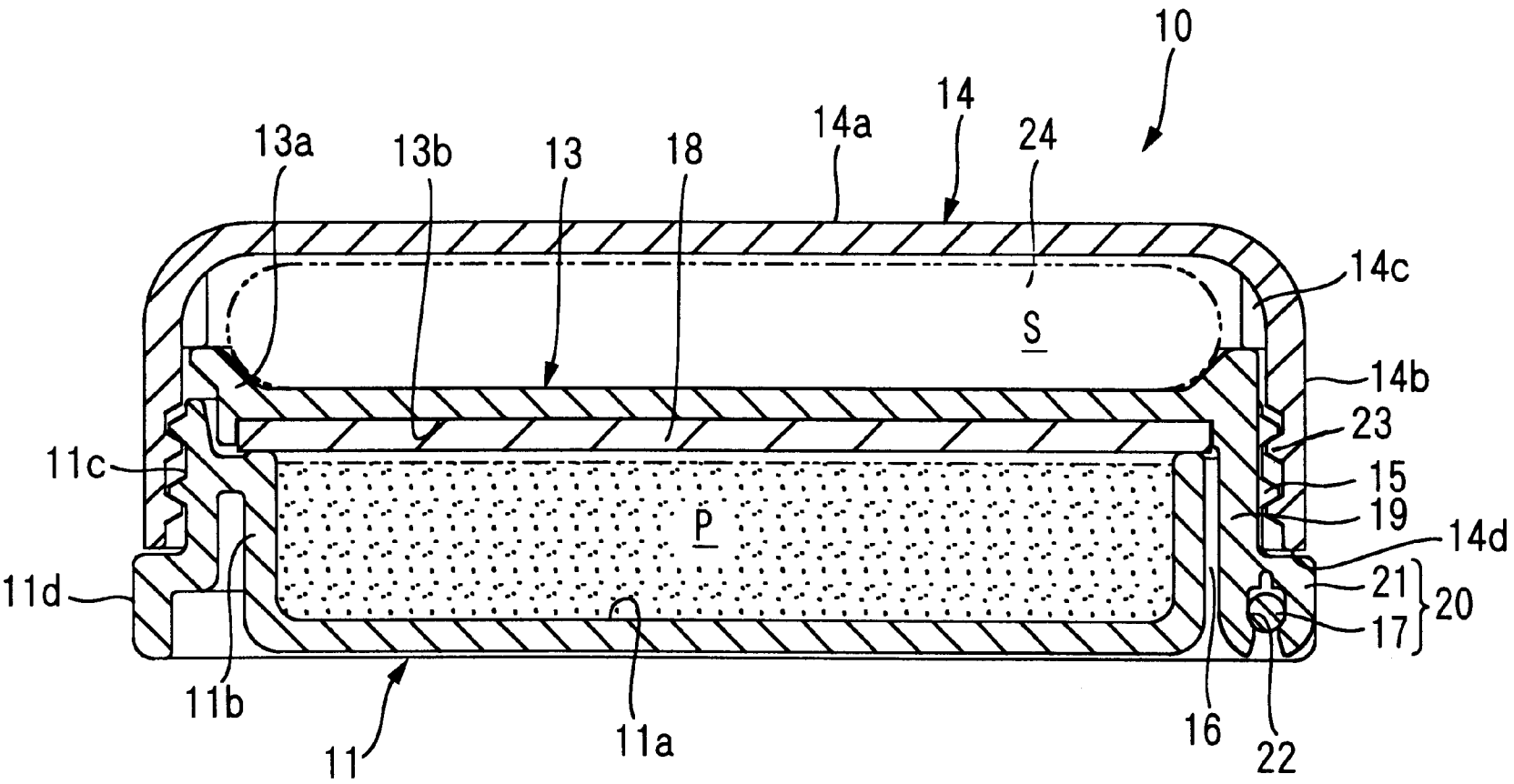
FIG. 6 is a side view cross section of the third embodiment of the invention with the external cover attached.

A third embodiment of the invention is shown in FIG. 6. This embodiment does not make use of cosmetic container 12, but instead places the cosmetic material directly into internal space 11*a*of main body part 11. Packing piece 18 comes into contact with the upper edge of internal wall 11*b* that defines internal space 11*a*. Internal cover 3 is able to move downward over internal space 11*a*with a compound rotational and linear movement provided by sliding yoke 22 sliding over hinge pin 17, thus allowing packing piece 18 to be compressed onto the upper edge of internal wall 11*b* with uniform pressure to effectively seal internal space 11*a*.

While the aforesaid explanations have embodied the invention as a portable cosmetic case, the structures presented here may also be applied to other types of containers. In regard to the structure of hinge 20, hinge pin 17 may be installed to internal lid 13, and hinge boss 21 to main body part 11. Moreover, the use of packing piece 18 is not required by the invention, as a sufficient sealing effect may be gained by internal lid 13 coming into direct contact with the upper edge of internal wall 11*b* or container wall 12*b*.

What is claimed is:

1. A structure for a sealable case comprised of, a main body part incorporating an external wall defining an internal space inside thereof and having a fastening thread formed on its external perimeter surface, an internal lid installed to said external wall of said main body part by means of a hinge so as to rotatably expose or seal said internal space, a separate external cover incorporating a cylindrical wall part having a screw thread formed on its inward facing surface, said screw thread interlocking with said fastening thread of said main body part as means of securely attaching said external cover to said main body part and pressing said internal lid toward said internal space, and a sliding yoke incorporated as part of said hinge, said yoke providing means of allowing said internal lid to simultaneously move in a linear direction when pressed down by an attachment of said external cover to said main body part.

2. A structure for a sealable case as put forth in claim 1 wherein;

a hinge pin and a rotating hinge boss of said hinge are provided with said external wall of said main body part and said internal lid respectively, said hinge boss movably connected to said hinge pin, and said sliding yoke is provided as an integral part of said hinge boss, said yoke allowing for a relative linear movement between said hinge boss and said hinge pin.

3. A structure for a sealable case as put forth in claim 2 wherein said sliding yoke is formed within said hinge boss as an elongated channel gripping said hinge pin.

4. A structure for a sealable case as put forth in claim 1 wherein;

an expanded portion, formed as a radially extending part of said external wall of said main body part, is located at the lower region of said cylindrical wall part of said external cover, a cutout space is formed in the direction of movement of said internal lid and extends downward through said expanded portion, a tongue part formed to said internal lid, extends downward through said cutout space up to said expanded portion, and said hinge is located between said internal lid tongue part and said expanded portion.

5. A structure for a sealable case as put forth in claim 4 wherein said expanded portion is formed as a circular flange, a diameter of said circular flange being formed to the same dimension as that of said cylindrical wall part of said external cover as means of aligning said circular flange and cylindrical wall part.

6. A structure for a sealable case as put forth in claim 1 wherein a pressure lip is provided on said external cover as means of contacting and applying force to said internal lid.

7. A structure for a sealable case as put forth in claim 6 wherein a contact seat is provided on said internal lid as means of receiving pressure applied by said pressure lip of said external cover.

8. A structure for a sealable case as put forth in claim 1 wherein a contact seat is provided on said internal lid as means of receiving pressure applied by said external cover.

9. A structure for a sealable case as put forth in claim 1 wherein a substance is stored in said internal space.

10. A structure for a sealable case as put forth in claim 9 wherein said internal lid comes into contact directly with an upper edge of said external wall of said main body part.

11. A structure for a sealable case as put forth in claim 10 wherein said internal lid incorporates a packing piece that comes into contact with the upper edge of said external wall of said main body part.

12. A structure for a sealable case as put forth in claim 1 wherein a separate removable container, incorporating a container wall, is provided as means of storing a substance within said internal space of said main body part, a location of an upper edge of said container wall being positioned at a point lower than an upper edge of said external wall of said main body part.

13. A structure for a sealable case as put forth in claim 12 wherein said internal lid comes directly into contact with the upper edge of said external wall of said main body part.

14. A structure for a sealable case as put forth in claim 13 wherein said internal lid incorporates a packing piece that comes into contact with the upper edge of said external wall of said main body part.

15. A structure for a sealable case as put forth in claim 1 wherein a separate removable container, incorporating a container wall, is provided as means of storing a substance within said internal space of said main body part, a location of an upper edge of said container wall being positioned at a point higher than an upper edge of said external wall of said main body part.

16. A structure for a sealable case as put forth in claim 15 wherein said internal lid comes directly into contact with the upper edge of said container wall of said container.

17. A structure for a sealable case as put forth in claim 16 wherein said internal lid incorporates a packing piece that comes into contact with the upper edge of said container wall of said container.

18. A structure for a sealable case comprised of, a main body part incorporating an external wall defining an internal space inside thereof and having a fastening thread formed on its external perimeter surface, an internal lid installed to said external wall of said main body part by means of a hinge so as to rotatably expose or seal said internal space, a separate external cover incorporating a cylindrical wall part having a screw thread formed on its inward facing surface, said screw thread interlocking with said fastening thread of said main body part as means of securely attaching said external cover to said main body part and pressing said internal lid toward said internal space, and a sliding hinge mechanism provided within said hinge as means of allowing said internal lid to move in a linear direction when said internal lid is pressed downward by said external cover, wherein;

said hinge utilizes a hinge pin and a rotating hinge boss provided with said external wall of said main body part and said internal lid respectively, said hinge boss being movably connected to said hinge pin, and said sliding hinge mechanism is comprised of an elongated channel formed within said hinge boss to grip said hinge pin and to allow for a relative linear movement between said hinge boss and said hinge pin.

19. A structure for a sealable case comprised of, a main body part incorporating an external wall defining an internal space inside thereof and having a fastening thread formed on its external perimeter surface, an internal lid installed to said external wall of said main body part by means of a hinge so as to rotatably expose or seal said internal space, a separate external cover incorporating a cylindrical wall part having a screw thread formed on its inward facing surface, said screw thread interlocking with said fastening thread of said main body part as means of securely attaching said external cover to said main body part and pressing said internal lid toward said internal space, an expanded portion formed as a radially extending part of said external wall of said main body part and located beneath said cylindrical wall part of said external cover, a cutout space formed on said external wall in the direction of movement of said internal lid, and extending downward through said expanded portion, a tongue part formed to said internal lid, and extending downward through said cutout space up to said expanded portion, and a sliding hinge mechanism provided within said hinge as means of allowing said internal lid to move in a linear direction when said internal lid is pressed downward by said external cover, wherein;

said hinge utilizes a hinge pin and a rotating hinge boss provided with said expanded portion of said external wall and said tongue part of said internal lid respectively, said hinge boss being movably connected to said hinge pin, and said sliding hinge mechanism is comprised of an elongated channel formed within said hinge boss to grip said hinge pin and to allow for a relative linear movement between said hinge boss and said hinge pin.

* * * * *